US008082993B2

(12) United States Patent
Craig

(10) Patent No.: US 8,082,993 B2
(45) Date of Patent: Dec. 27, 2011

(54) ONE TRIP GRAVEL PACK ASSEMBLY

(75) Inventor: William S. Craig, Bakersfield, CA (US)

(73) Assignee: Halliburton Energy Services, Inc., Houston, TX (US)

( * ) Notice: Subject to any disclaimer, the term of this patent is extended or adjusted under 35 U.S.C. 154(b) by 386 days.

(21) Appl. No.: 12/402,602

(22) Filed: Mar. 12, 2009

(65) Prior Publication Data

US 2010/0230098 A1 Sep. 16, 2010

(51) Int. Cl.
*E21B 43/04* (2006.01)

(52) U.S. Cl. ..... 166/278; 166/51

(58) Field of Classification Search ..... 166/278, 166/51

See application file for complete search history.

(56) References Cited

U.S. PATENT DOCUMENTS

| | | | | |
|---|---|---|---|---|
| 5,636,691 | A | 6/1997 | Hendrickson et al. | |
| 6,378,609 | B1 | 4/2002 | Oneal et al. | |
| 6,702,020 | B2 | 3/2004 | Zachman et al. | |
| 6,725,929 | B2 | 4/2004 | Bissonnette et al. | |
| 7,128,151 | B2 | 10/2006 | Corbett | |
| 7,140,437 | B2 * | 11/2006 | McMechan et al. | 166/278 |
| 7,337,840 | B2 | 3/2008 | Penno | |
| 7,520,326 | B1 * | 4/2009 | Hill et al. | 166/278 |
| 7,891,423 | B2 * | 2/2011 | Dykstra | 166/253.1 |
| 2007/0039741 | A1 * | 2/2007 | Hailey, Jr. | 166/376 |

* cited by examiner

*Primary Examiner* — William P Neuder
(74) *Attorney, Agent, or Firm* — Michael W. Piper

(57) ABSTRACT

A method of completing a wellbore is provided. The method comprises running in a screen, a gravel pack assembly comprising a flow diversion tool, and a completion string in a first trip. The method also comprises gravel packing the well and removing the flow diversion tool from the gravel pack assembly and from the completion string.

20 Claims, 7 Drawing Sheets

ONE TRIP GRAVEL PACK ASSEMBLY

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Oil and gas wells may be completed in a producing formation containing fines and sand which may flow with the fluids produced from the formation, whether the well is completed as an open hole or as a cased hole. The fines and sand in the produced fluids can abrade and otherwise damage completion equipment, for example seals, pump seats, rod pumps, completion tubing, and other completion equipment. To control fines and sand propagation into the completion equipment, filters (e.g., sand screens) may be installed in the completion equipment string and gravel may be packed around the screen, for example at the bottom of the wellbore.

A gravel packing completion operation may include flowing gravel laden fluid or gel down an interior of the completion string, through a gravel port, and out into a formation proximate to the wellbore. In some wells, the wellbore may be fully cased and the casing perforated. In some wells, the formation proximate to the wellbore may be fractured to enhance fluid production from the formation. The gravel laden fluid or gel may flow out through the casing perforations and into the formation, in part helping to prop the formation and enhance fluid flow, in part providing a barrier to propagation of fines and sand with fluid flow towards the completion string. The gravel packing completion operation may continue with packing gravel around the completion string screen, for example by flowing gravel laden fluid or gel down the wellbore, out a gravel port, into the annulus between the completion equipment and the wellbore and/or casing, down to the completion string screen where the gravel packs around the screen and the fluid or gel passes through the screen and up the interior of a lower portion of the completion string below the gravel port, through a cross-over port, up above a packer sealing the annulus above the packer from the annulus below the packer, and returning to surface in the annulus between the completion string and the wellbore and/or casing.

After gravel packing, non-gravel bearing fluid or gel may be reverse circulated up the interior of the completion string to remove the remaining gravel from the interior of the completion string, for example flowing non-gravel bearing fluid or gel down the annulus between the wellbore and/or casing and the exterior of the completion string, through the cross-over port, out a reverse circulate port, in the gravel port, and up the interior of the completion string. The gravel packing may be tested by determining a pressure differential across the gravel pack. In different circumstances different pressure differentials may be preferred, but in an embodiment a pressure differential of about 1000 PSI across the gravel pack and the completion screen at a standard flow rate may be deemed an indication of a successful gravel pack.

SUMMARY

In an embodiment, a method of completing a wellbore is disclosed. The method comprises running in a screen, a gravel pack assembly comprising a flow diversion tool, and a completion string in a first trip. The method also comprises gravel packing the well and removing the flow diversion tool from the gravel pack assembly and from the completion string.

In an embodiment, a well completion tool is disclosed. The completion tool comprises a gravel pack assembly and a diverter tool. The diverter tool is releasably coupled to the gravel pack assembly in a run-in state of the completion tool and is removed from the gravel pack assembly in a production state of the completion tool.

In an embodiment, another method of wellbore completion is disclosed. The method comprises flowing a gravel slurry out of a gravel pack assembly, the gravel pack assembly comprising a cross-over port. The method further comprises placing a well associated with the wellbore on production while leaving the cross-over port of the gravel pack assembly in the wellbore.

In another embodiment, a downhole production assembly is disclosed. The downhole production assembly comprises a flow control valve, a mechanically actuated packer, a gravel pack assembly, and a screen. The mechanically actuated packer is coupled to the flow control valve in a run-in state of the production assembly. The gravel pack assembly is coupled to the mechanically actuated packer and comprises an outer assembly defining a cross-over port, a gravel port, and a reverse circulation port. The gravel pack assembly further comprises an inner assembly carried within the outer assembly that is coupled to the flow control valve and defines a first port aligned with the gravel port and a second port aligned with an opening of the cross-over port in the run-in state of the production assembly. The gravel pack assembly further comprises a diverter tool carried with the inner assembly in the run-in state of the production assembly and removed from the inner assembly in a production state of the production assembly. The screen is coupled to the gravel pack assembly.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
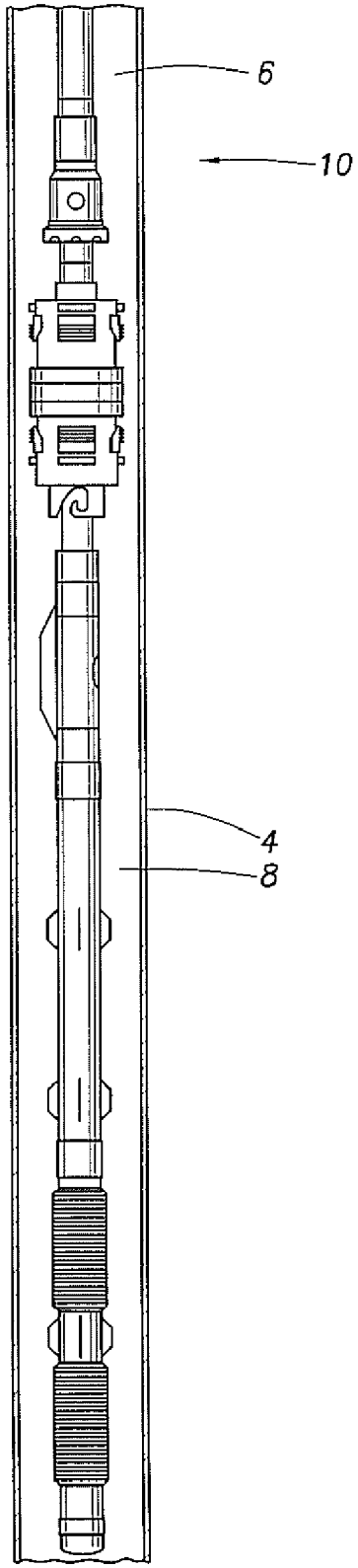
FIG. 1A, FIG. 1B, FIG. 1C, and FIG. 1D illustrate a production string according to an embodiment of the disclosure.
Figure 1B:
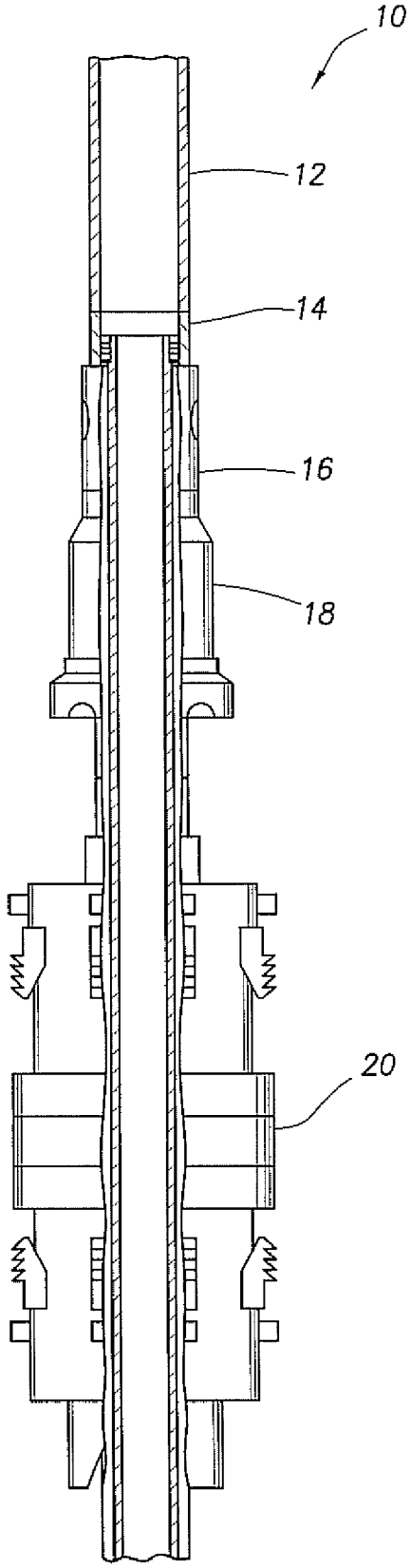
Figure 1C:
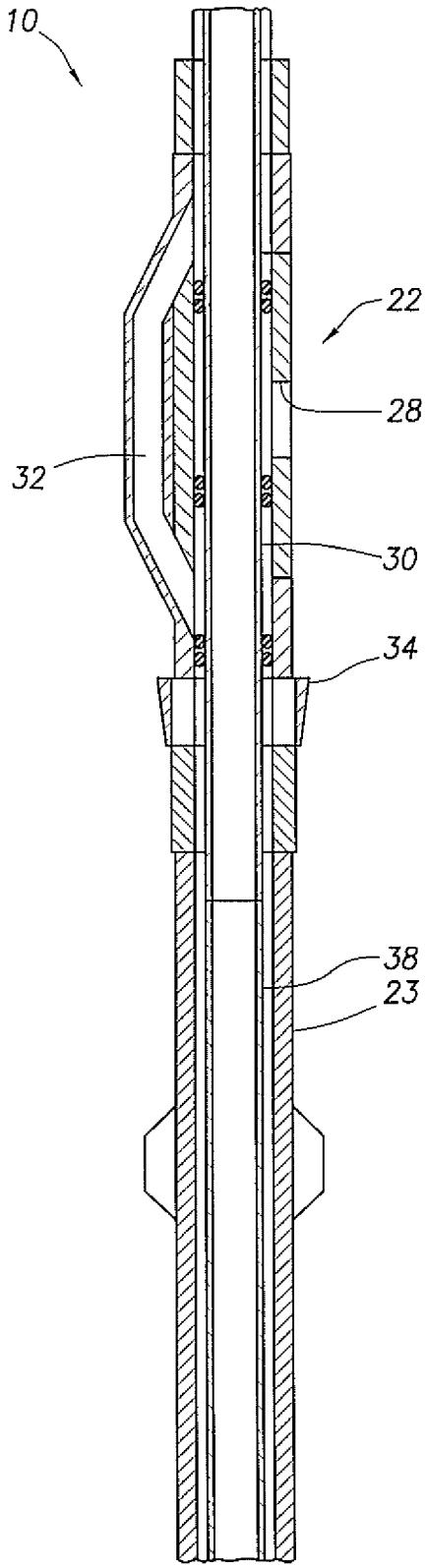
Figure 1D:
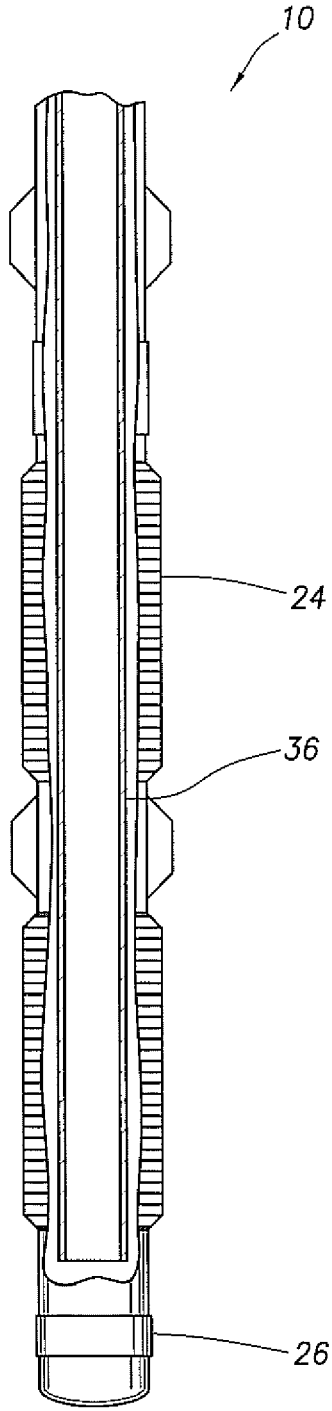

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

In an embodiment, a gravel pack assembly, which in some contexts may be referred to as a gravel control subassembly or a one trip weldment subassembly, is taught by the present disclosure. In an embodiment, a completion string comprising the gravel pack assembly, a screen, a mechanically actuated packer, a flow control valve, and other completion equipment described in greater detail hereinafter may be run into a wellbore in a first trip; a variety of completion procedures including gravel packing may be performed; a diverter tool portion of the gravel pack assembly may be retrieved by a retrieval tool run into the wellbore on one of a sand line, a slick line, a wire line, a coiled tubing, a pipe string, or on another conveyance; after which the well may be placed on production, leaving the gravel pack assembly downhole. In some embodiments, for example when formation pressure does not motivate hydrocarbons to flow freely up the production string, a rod pump coupled to a rod string may be run into the wellbore to place the well on production. In some contexts the flow control valve may be referred to as a circulation control valve.

A gravel pack assembly, as used herein, is a device or subassembly to deliver, direct, and/or dispose gravel to and/or in a wellbore. In an embodiment, a gravel pack assembly may promote gravel packing a wellbore, for example packing gravel into an annulus between a wellbore and a completion and/or production string, for example a screen. In an embodiment, the gravel pack assembly may promote both flowing gravel, gravel laden slurry, and/or gravel laden gel from the surface to a gravel pack zone and flowing substantially gravel free fluid away from the gravel pack zone, for example to flush a work string, a completion string, or a production string of gravel. In an embodiment, the gravel pack assembly may promote delivering, directing, and/or disposing other fluids or materials in the wellbore pursuant to completion activities. In an embodiment, the gravel pack assembly may be deployed into the wellbore along with other completion equipment, for example one or more screens, one or more blank pipes, a packer, a flow control valve, and other completion equipment.

In an embodiment, the gravel pack assembly, in combination with some of the other completion equipment, for example the flow control valve, is operable to selectively direct flow (1) to deliver gravel slurry to a formation proximate to the wellbore in a "squeeze" operation mode to pack gravel into the formation while blocking fluid flow in through the screen, (2) to deliver gravel slurry to gravel pack around the sand screen by admitting fluid flow in through the screen, and (3) to deliver a gravel free reverse circulation fluid out a reverse circulate port and to receive the reverse circulation fluid in the gravel door to flush the gravel bearing slurry out of the completion string. These operations are completed based on performing a single trip into the wellbore, thereby reducing the number of trips to put a well on production, thereby reducing costs of placing the well on production. For example, an alternative completion procedure may comprise at least two additional round trips that are avoided in the above procedure using the gravel pack assembly of the present disclosure. The alternative completion procedure may comprise (1) trip into the hole with a packer or cup-type tool; (2) back off of the liner top and trip out of the hole; (3) trip into the hole with a drive-on adapter that seals the top of the liner; (4) trip out of the hole; (5) trip into the hole with the production string to set the production tail and/or pump shoe; and (6) trip into the hole with rod pump and rods. In another alternative completion procedure, the flow control valve, the packer, and/or the gravel pack assembly may be tripped out of the hole before tripping into the hole with rod pump and rods.

In an embodiment, the gravel pack assembly comprises a diverter tool that defines different flow paths through the gravel pack assembly in response to the sense of fluid pressure differentials and/or fluid flow direction. For example, the diverter tool in a first state of the gravel pack assembly promotes flow of gravel slurry out the gravel pack assembly and into a formation proximate to the gravel pack assembly, blocking fluid flow across a sand screen and up the interior of the completion string. In a second state of the gravel pack assembly, the diverter tool promotes flow of gravel slurry out the gravel pack assembly, to pack in the annulus between the wellbore and the screen, and flow of carrier fluid separated by the screen from the gravel slurry through a cross-over port of the gravel pack assembly and up an annulus between the completion string and the wellbore above a packer. In a third state of the gravel pack assembly, the diverter tool promotes flow of fluid through a cross-over port, out a reverse circulate port of the gravel pack assembly, back into the gravel pack assembly, and up the interior of the completion string to flush gravel from the completion string. In a fourth state of the gravel pack assembly, the gravel pack assembly remains downhole while the well is placed on production and produces, for example flowing hydrocarbons freely from a formation to the surface and/or at least partially lifting the hydrocarbons to the surface by a rod pump and pump rods motivated at the surface. In an embodiment, the gravel pack assembly may be adapted to operate in at least five different states: a run-in state, a squeeze state, a gravel pack state, a re-circulate state, and a production state. In an embodiment, the run-in state and the squeeze state of the gravel pack assembly may be substantially identical. In an embodiment, the gravel pack assembly may be adapted to operate in either three states or four states.

The diverter tool may take a number of forms. In one embodiment, the diverter tool comprises a multi-position valve to structurally define flow paths in response to wellbore conditions controlled from the surface, for example fluid flow directions and/or fluid pressure differentials. In an embodiment, the multi-position valve is a one-way valve that allows fluid flow in one direction and restricts and/or checks fluid flow in another direction. In an embodiment, the one-way valve may be embodied as a check ball and a check ball valve seat. Other embodiments of a one-way valve may be implemented, according to design choices. Other multi-position valves may be implemented. In an embodiment, a component of the gravel pack assembly may move in response to differential pressure to open a previously blocked fluid flow path. In an embodiment, on completion of the gravel pack operations and optional additional completion operations, the diverter tool is retrieved from the gravel pack assembly on one of a sand line, a wire line, a slick line, or a coiled tubing, leaving the remainder of the gravel pack assembly downhole. At this point—leaving the gravel pack assembly, minus the diverter tool, downhole—the well may immediately be placed on production, with no further trips. In some wells hydrocarbons do not flow freely up the production string under their own motivation, for example motivated by formation pressure, and may benefit from mechanical lift. In an embodiment, after retrieving the diverter tool from the gravel pack assembly and leaving the gravel pack assembly downhole, a rod pump and rods may be tripped into the hole, and the well may then be placed on production.

Turning now to FIG. 1A, FIG. 1B, FIG. 1C, and FIG. 1D, a completion string 10 in a wellbore 4 is described. In some contexts, the completion string 10 may also be referred to as a production string because much of the completion string 10 remains in the wellbore 4 after the well has been placed on production. In some contexts, the completion string 10 may be referred to as a production assembly. The completion string 10 comprises a production tubing 12, a first coupling component 14, a flow control valve 16, a second coupling component 18, a mechanically actuated packer 20, a gravel pack assembly 22, a screen 24, and a plug 26. In some contexts, the completion string 10 may be referred to as excluding the gravel pack assembly 22 and the screen 24, for example, running the completion string 10 may be referred to in some contexts as running in a screen, a gravel pack assembly, and a completion string. In other embodiments, the completion string 10 may comprise fewer components, but in a preferred embodiment the completion string 10 comprises at least the mechanically actuated packer 20, the gravel pack assembly 22, and the screen 24. In an embodiment, the mechanically actuated packer 20 may be replaced by a hydraulically actuated packer or other kind of packer.

In an embodiment, the first coupling component 14 may be implemented as a three-way adapter, but in other embodiments the first coupling component 14 may be implemented as a different coupling apparatus. In some contexts the flow control valve 16 may be referred to as a circulation control valve. In an embodiment, the second coupling component 18 may be implemented as an on-off tool, but in other embodiments the second coupling component 18 may be implemented as a different coupling apparatus. It is understood that in different embodiments the completion string 10 may comprise multiple screens 24 and one or more joints of blank pipe 23 between the gravel pack assembly 22 and the screen 24. Further, it is understood that in different embodiments some of the components of the completion string 10 enumerated above may not be present and/or that in different embodiments the functionality provided by two or more components of the completion string 10 enumerated above may be combined in a single component. In the following descriptions, directional terms such as "up," "down," "upper," "lower," "upward," "downward," etc., are used in relation to the gravel pack assembly 22 as it is depicted in the figures. It is understood that the gravel pack assembly 22, and other components of the completion string 10, may be utilized in vertical, horizontal, inverted, or inclined orientations without departing from the teachings of the present disclosure.

In an embodiment, the completion string 10 is run into the wellbore 4 and the packer 20 is set in the wellbore 4. The packer 20 substantially isolates a first annulus 6 defined between the wellbore 4 and/or casing and the production tubing 12 above the packer 20 from a second annulus 8 defined between the wellbore 4 and/or casing and the completion string 10 below the packer 20. In an embodiment, the packer 20 may provide about 10,000 pounds per square inch (PSI) isolation between the first annulus 6 and the second annulus 8.

In an embodiment, the gravel pack assembly 22 comprises a gravel port 28, a diverter mandrel 30, a cross-over port 32, and a reverse circulate port 34. In some contexts, the gravel pack assembly 22 may be said to define the gravel port 28, the cross-over port 32, and the reverse circulate port 34. In an embodiment, the diverter mandrel may extend up through the packer 20, up through the second coupling component 18, up through the flow control valve 16, and couple to the first coupling component 14. In an embodiment, the diverter mandrel 30 may be provided as a single component; in another embodiment, however, the diverter mandrel 30 may be provided as a plurality of components that couple together during assembly of the completion string 10, for example coupling together threadingly. In an embodiment, the diverter mandrel 30 may be a wash pipe or coupled to a wash pipe. In an embodiment, the completion string 10 may comprise a rod pump seat nipple 36 installed in the diverter mandrel 30 or in a wash pipe coupled to the diverter mandrel 30.

Turning now to FIG. 2A, FIG. 2B, FIG. 2C, and FIG. 2D, the gravel pack assembly 22 is described. In an embodiment, the gravel pack assembly 22 comprises an outer assembly 50 that defines the gravel port 28, the diverter mandrel 30, a diverter tool 52, a ball check seat 56, and a check ball 58. In some contexts, the diverter mandrel 30 may be referred to as an inner assembly. The diverter tool 52 comprises a bulkhead 54 that blocks fluid flow downwards through the diverter tool 52.

In an embodiment, the ball check seat 56 is coupled to or carried with or within the diverter tool 52 and is adapted to and/or configured to shift relative to the diverter tool 52 from a first position to a second position in response to a force controlled from the surface, for example a pressure differential, as discussed further hereinafter. In the shifted position the ball check seat 56 may open a flow path from the interior of the diverter tool 52 out the reverse circulate port 34. In another embodiment, however, the ball check seat 56 does not shift and remains in a fixed position relative to the diverter tool 52, at least while the diverter tool 52 remains within the gravel pack assembly 22. In another embodiment, the gravel pack assembly 22 may comprise another type of valve or another kind of one-way valve carried within or with the diverter tool 52 that provides the fluid flow control functions of the ball check seat 56 and the check ball 58. For example, the one-way valve may comprise a flapper valve including a flapper coupled to a flapper valve seat that rotates about a hinge to open and allow fluid flow in one direction and rotates about the hinge in the opposite direction to close and block fluid flow in a second direction. Alternatively, the one-way valve may comprise another form of one-way valve. In an embodiment, a micro-annulus 60 is defined between the outer assembly 50 and the diverter mandrel 30. In another embodiment, however, a different interior passage of the gravel pack assembly 22 or an external pipe or an external tubing may perform the fluid communication function of the micro-annulus 60.

In an embodiment, the diverter mandrel 30 defines a first port 62 that aligns with the gravel port 28 when the gravel pack assembly 22 is in a run-in state. The diverter mandrel 30 defines a second port 64 that aligns with a lower opening of the cross-over port 32 when the gravel pack assembly 22 is in the run-in state. The diverter mandrel 30 defines a third port 66 that aligns with the reverse circulate port 34 when the gravel pack assembly 22 is in the run-in state.

The diverter tool 52 defines a fourth port 72 that aligns with the second port 64 defined by the diverter mandrel 30 and with the lower opening of the cross-over port 32 when the gravel pack assembly 22 is in the run-in state. The diverter tool 52 defines a fifth port 74 that aligns with the third port 66 and with the reverse circulate port 34 when the gravel pack assembly 22 is in the run-in state.

In an embodiment, the gravel pack assembly 22 further comprises a sleeve 76 carried between the outer assembly 50 and the diverter mandrel 30. In an embodiment, the sleeve 76 defines a plurality of ports. The sleeve 76 is slidable to close off various openings of the gravel pack assembly 22 when in an on-production state or in a production state. In the run-in state of the gravel pack assembly 22, the ports defined by the sleeve 76 align to permit fluid flow through the various ports in the outer assembly 50, the diverter mandrel 30, and the diverter tool 52. In an embodiment, the sleeve 76 defines a sixth port 78 that aligns with the gravel port 28 and the first port 62 in the run-in state of the gravel pack assembly 22. In an embodiment, the sleeve 76 defines a seventh port 80 that aligns with the lower opening of the cross-over port 32, with the second port 64 defined by the diverter mandrel 30, and with the fourth port 72 defined by the diverter tool 52 in the run-in state of the gravel pack assembly 22. In an embodiment, the sleeve 76 defines an eighth port 82 that aligns with the reverse circulate port 34, with the third port 66 defined by the diverter mandrel 30, and with the fifth port 74 defined by the diverter tool 52 in the run-in state of the gravel pack assembly 22. Alternatively, in another embodiment, the sleeve 76 may not define any ports and may be located below or above the various openings of the gravel pack assembly 22.

In some embodiments, a different arrangement of ports may be implemented. For example, in some embodiments, the outer assembly 50 may define two or more reverse circulate ports 34; the diverter mandrel 30 may define two or more third ports 66; the diverter tool 52 may define two or more fifth ports 74. In an embodiment, one or more seals, for example O-ring seals, may be employed in the gravel pack assembly 22 to isolate chambers defined by the outer assembly 50, the diverter mandrel 30, the diverter tool 52, and the ball check seat 56. For example, a first seal 68A, a second seal 68B, a third seal 68C, and a fourth seal 68D may be employed to define and isolate various chambers and flow paths of the gravel pack assembly 22, for example the mirco-annulus 60.

In an embodiment, in a squeeze mode of operation and/or state of the completion string 10, the flow control valve 16 is closed and a gravel slurry is pumped from the surface into the completion string 10 and flows down the interior of the production tubing 12, flows down the interior of the diverter mandrel 30, is blocked by the bulkhead 54, flows out the gravel port 28, and flows out into the second annulus 8. The gravel slurry may comprise a carrier fluid and/or a gel as well as gravel. As is known to those of ordinary skill in the art, gravel may comprise any of proppants, sand, and other particulate matter. Gravel may comprise particles of various size or granularity. The closed flow control valve 16 prevents flow of the gravel slurry through the screen 24, into the diverter mandrel 30 and/or wash pipe, into the cross-over port 32, and up the micro-annulus 60. For example, when the micro-annulus 60, the cross-over port 32, and the diverter mandrel 30 and/or wash pipe are filled with a non-compressible fluid, such as circulation fluid, closing the flow control valve 16 prevents any motion of the non-compressible fluid and hence substantially excludes entrance of the carrier fluid into the diverter mandrel 30 and/or wash pipe by passing through the screen 24. In the squeeze mode, the gravel slurry flows under pressure through perforations in the casing and/or wellbore 4 into the formation proximate to the perforations.

In an embodiment, in a circulation mode of operation and/or state of the completion string 10, the flow control valve 16 is opened and the gravel slurry is pumped from the surface into the completion string 10. The gravel slurry flows from the gravel port 28 down the second annulus 8, the gravel packs into the second annulus 8 proximate to and around the screen 24, and a carrier fluid of the gravel slurry passes through the screen 24. The carrier fluid flows up the interior of the diverter mandrel 30 and/or wash pipe below the diverter tool 52, pushes the check ball 58 off of a seal located in the bottom of the ball check seat 56, flows out the fourth port 72 defined by the diverter tool 52, out the second port 64 defined by the diverter mandrel 30, in the lower opening of the cross-over port 32, up the micro-annulus 60, out the flow control valve 16, into the first annulus 6, and is received as returns at the surface. In the circulation mode of operation, gravel is packed in the second annulus 8 proximate to and around the screen 24 in a standard gravel pack. In an embodiment, the gravel pack may be deemed to be successfully completed when a pressure differential of about 1,000 PSI is determined to exist across the gravel pack, for example between the second annulus 8 below the gravel port 28 and the interior of the screen 24. While in the circulation mode of operation, the gravel slurry flows out the gravel port 28, down the second annulus 8, and the carrier fluid passes through the screen 24 and up the interior of the diverter mandrel 30 and/or wash pipe, in an alternative embodiment the flow direction and/or path of the carrier fluid may take alternative paths of flow direction through the gravel pack assembly 22 and up to the first annulus 6.

Figure 2A:
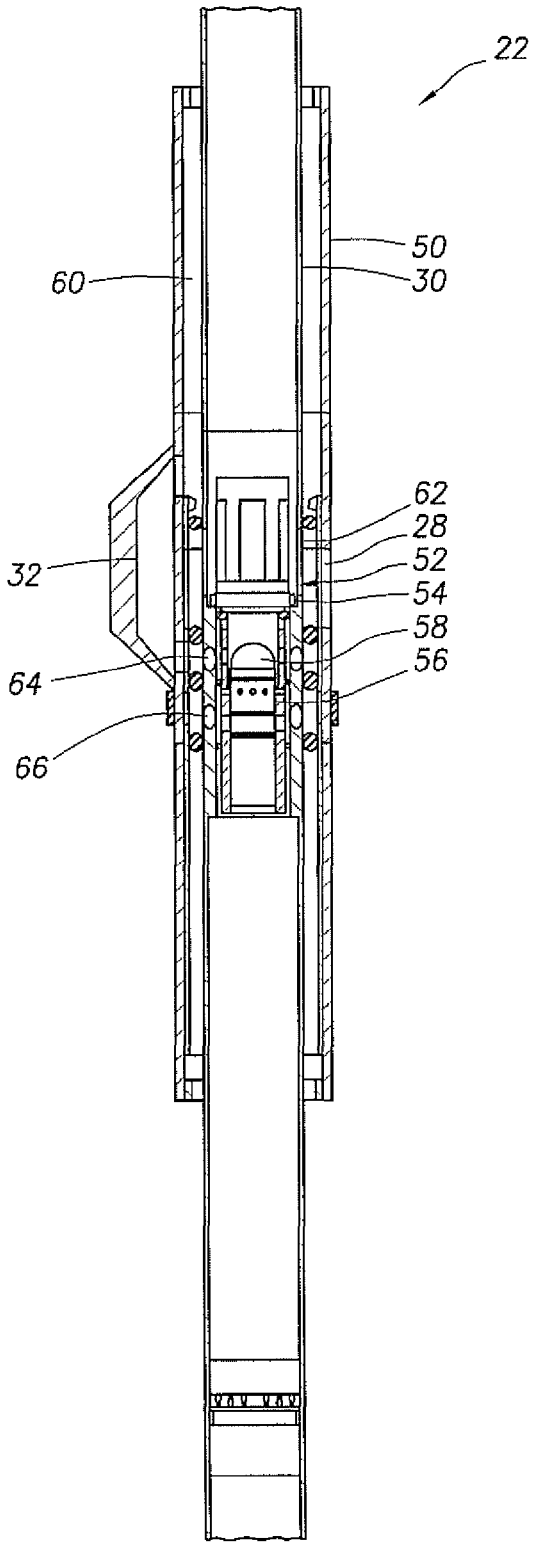
FIG. 2A, FIG. 2B, FIG. 2C, and FIG. 2D illustrate a gravel pack assembly according to an embodiment of the disclosure.
Figure 2D:
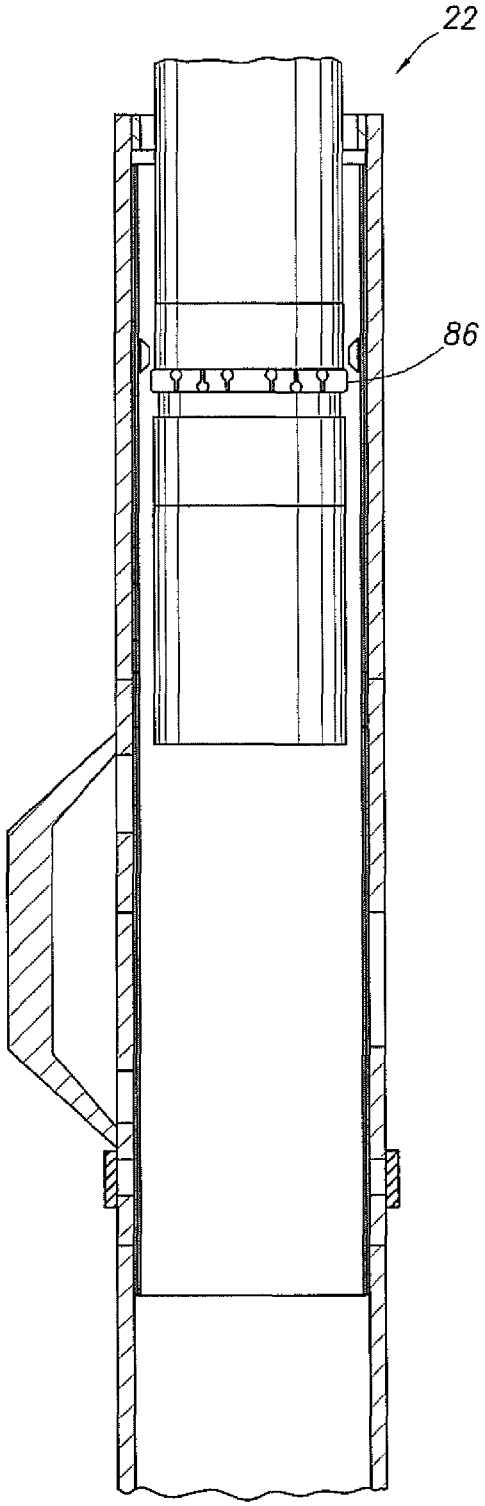
Figure 2B:
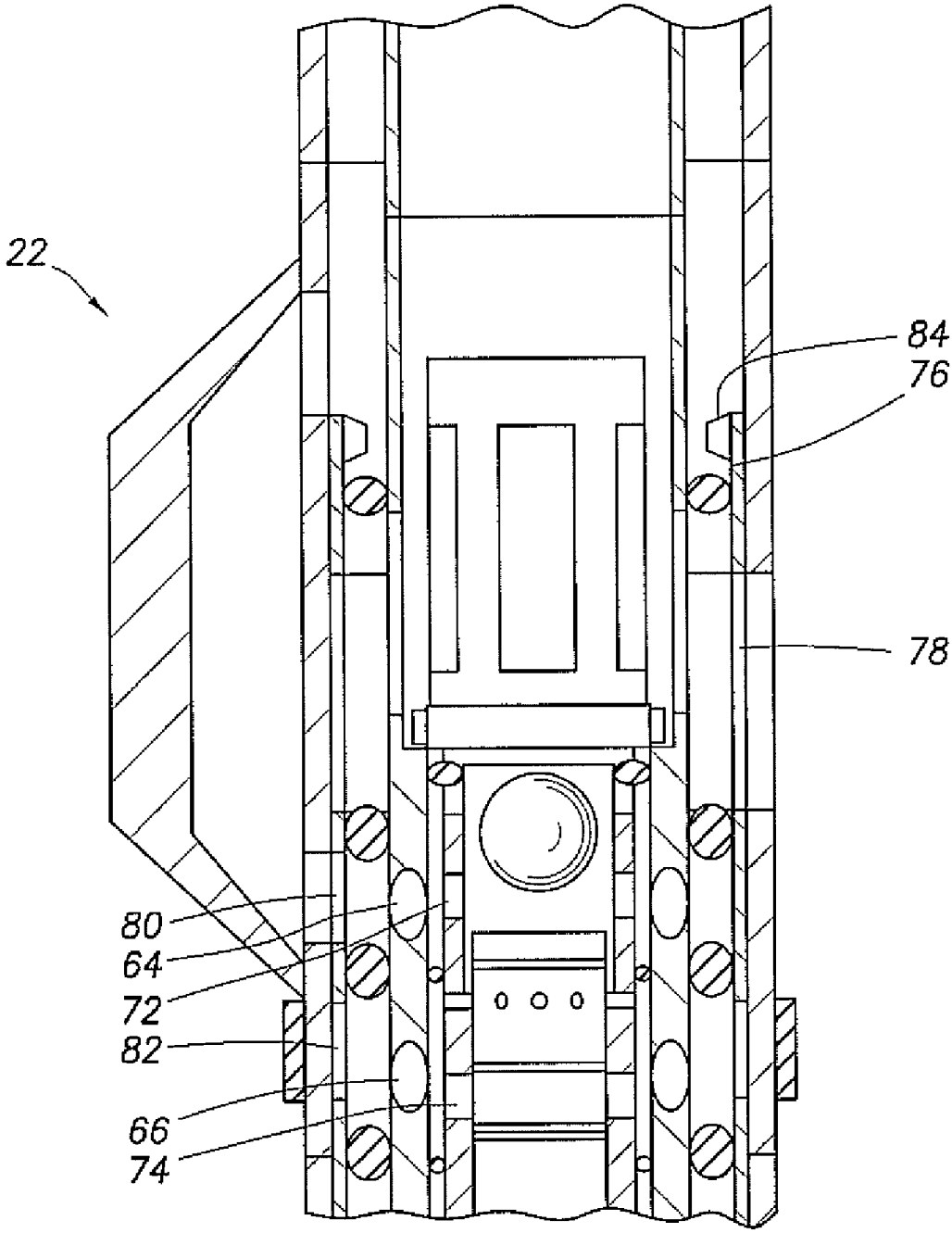
Figure 2C:
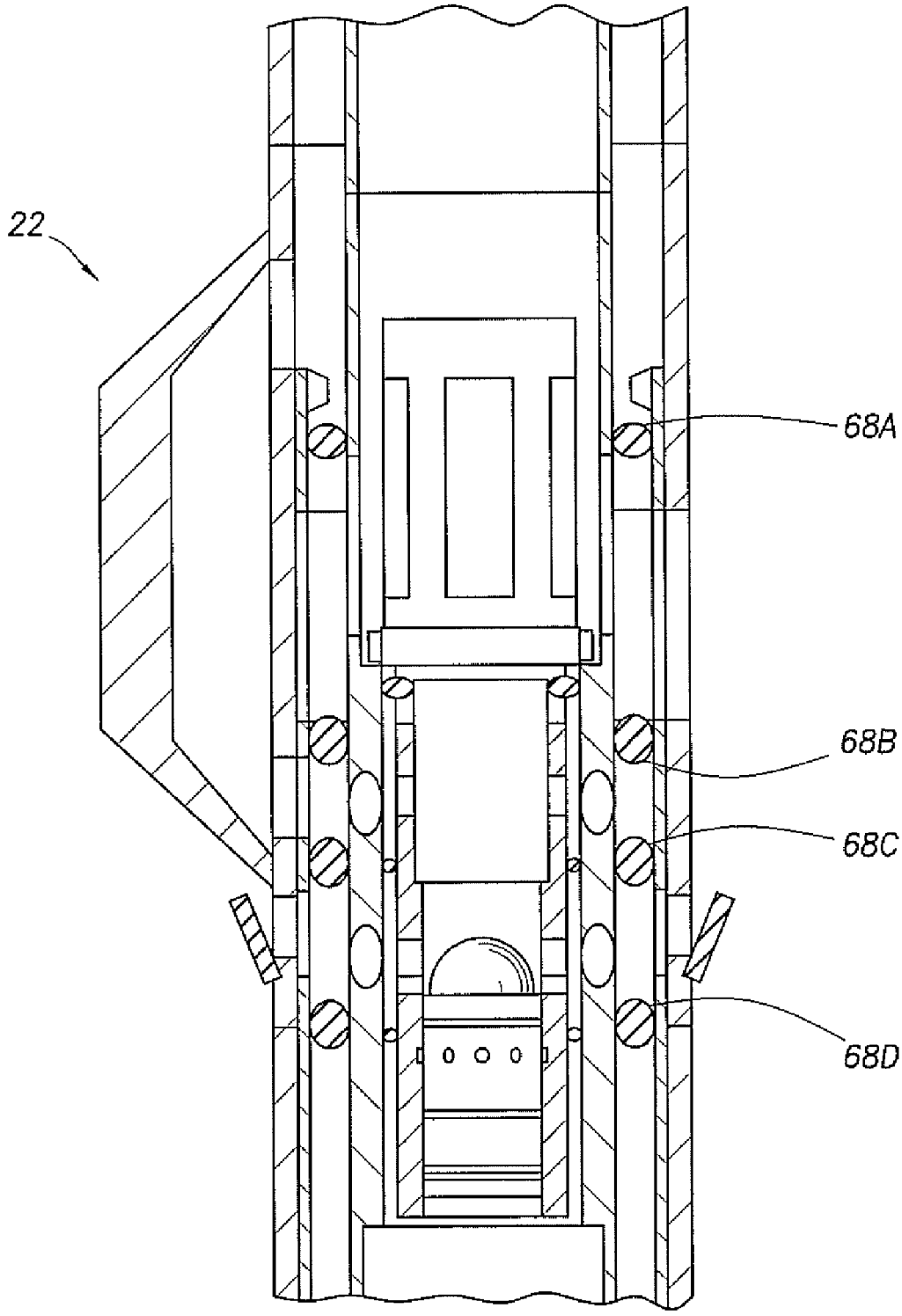

In an embodiment, in a reverse circulation mode of operation and/or state of the completion string 10, a fluid is pumped down the first annulus 6, flows into the flow control valve 16, flows down the micro-annulus 60, down the cross-over port 32, in the second port 64 defined by the diverter mandrel 30, in the fourth port 72 defined by the diverter tool 52, and drives the check ball 58 onto the seal located in the bottom of the ball check seat 56. Referring now to FIG. 2C, with no flow path available, force is exerted downwards on the ball check seat 56 by the fluid by a pressure differential between the interior of the diverter tool 52 and the interior of the diverter mandrel 30 below the ball check seat 56.

The downwards directed force shifts the ball check seat 56 downwards, opening a flow path from the fourth port 72 to the fifth port 74. Prior to being shifted downwards, the ball check seat 56 blocked and sealed the fifth port 74. Prior to being shifted downwards, the ball check seat 56 may be held in position by one or more shear retainers designed to shear and release the ball check seat 56 to shift downwards when subjected to a defined shear force. In an embodiment, the shear retainers may be implemented as shear pins or as other shearing structural mechanisms. In another embodiment, however, the ball check seat 56 does not shift and remains in position relative to the diverter tool 52. In an embodiment, for example, the ball check seat 56 may not block the fifth port 74 in a run-in state of the gravel pack assembly 22.

The fluid flows through the fourth port 72, flows through the fifth port 74, flows out the reverse circulate port 34, up the second annulus 8, flows in the gravel port 28, flows in the first port 62 defined by the diverter mandrel 30, flows up the interior of the diverter mandrel 30, flows up the interior of the production tubing 12, and is received as returns at the surface. In the down-shifted position, in the reverse circulation mode of operation, the ball remains driven onto the seal located in the bottom of the ball check seat 56, and the flow path through the bottom of the ball check seat 56 down the diverter mandrel 30 and/or wash pipe, out the screen 24 is blocked. In some embodiments, a different one-way valve and one-way valve seat may be implemented in the gravel pack assembly 22, but the principle of operation of the one-way valve and the one-way valve seat conform substantially with the operation described above with reference to the ball check seat 56 and the check ball 58.

In an embodiment, a reversing boot 83 or other one-way valve is provided to cover the reverse circulate port 34. During reverse circulation the fluid flows out through the reverse circulate port 34 and pushes open the reversing boot 83. In an embodiment, the reversing boot 83 may be an elastomer. In some contexts the reversing boot 83 may be referred to as an elastomeric boot. The reverse circulation operation is conducted to clear the interior of the completion string 10 of gravel. When the returns at the surface are effectively free of gravel for a period of time, the reverse circulation operation may be deemed completed.

In an embodiment, the gravel pack assembly 22 and the contained diverter tool 52 provide for at least the three different operational modes and/or states—squeeze operational mode, circulate operational mode, and reverse circulation operational mode—and provide for three associated flow paths of the gravel slurry and/or carrier fluid—without having to lift up the completion string 10. The three operational modes and/or states and associated flow paths of the gravel pack assembly 22 are controllably achieved simply by opening or closing the flow control valve 16, which in an embodiment may be accomplished by rotating the completion string 10, and by controlling the sense of fluid and/or gravel slurry flow in the production tubing 12 and the first annulus 6.

In an embodiment, the gravel pack operation may be pressure tested to confirm the success of the gravel pack operation. If needed, the squeeze operation, the circulation operation, and/or the reverse circulation operation may be repeated. Note that in the circulation operation, after the ball check seat 56 has been down-shifted, the reversing boot 83 may block the flow path from the gravel port 28 in through the reverse circulate port 34. Because of the gravel pack around the screen 24, a pressure differential of about 1,000 PSI may be experienced across the reversing boot 83 during the circulation operation after the ball check seat 56 has been down-shifted. The reversing boot 83 or other form of one-way valve associated with the reverse circulate port 34 may be designed to sustain more than a 1,000 PSI pressure differential.

After the gravel pack is completed, the diverter tool 52 may be retrieved from the gravel pack assembly 22. For example, a retrieval tool, such as a GS pulling tool or a GR pulling tool, may be run in on a rig sand line, on a slick line, on a wire line, or on coil tubing; the retrieval tool may engage the diverter tool 52; and the retrieval tool along with the diverter tool 52 may be withdrawn from the gravel pack assembly 22 and from the completion string 10. Note that retrieving the diverter tool 52 using a retrieval tool coupled to a rig sand line does not involve a standard trip into the well or a standard trip out of the well and can be completed much more quickly than a standard round trip. For example, a standard trip into the well may comprise more than 10 connection operations, for example pipe joint connections, sometimes many more than 10 connection operations, depending on the depth of the wellbore 4. Likewise, a standard trip out of the well may comprise more than 10 disconnection operations, for example pipe joint disconnections, sometimes many more than 10 disconnection operations, depending on the depth of the wellbore. The check ball seat 56 and the check ball 58, or other one-way valve and one-way valve seat, are withdrawn together with the diverter tool 52, leaving the bore of the completion string 10 open to the plug 26. In an embodiment, the diverter tool 52 may be retrieved by a pipe string, which may comprise an extra trip into the wellbore 4 and an extra trip out of the wellbore 4.

In an embodiment, the diverter mandrel 30 may be lifted to engage a lip 84 coupled to an upper portion of the interior of the sleeve 76 with a ring 86 coupled to the outside of the diverter mandrel 30, thereby shifting the sleeve 76 upwards to a completion state of the gravel pack assembly 22. In the completion state of the gravel pack assembly 22, the sleeve 76 closes the lower opening of the cross-over port 32, closes the gravel port 28, and closes the reverse circulate port 34. Continuing to lift up, an outer edge of the ring 86 shears by design and drops out of the way. The shearing of the ring 86 can be observed at the surface as a transient unloading of the completion string 10 and may provide a positive indication that the sleeve 76 has been closed. After shifting the sleeve 76 upwards, the diverter mandrel 30 may be lowered and returned to position.

In some circumstances, the well may be ready to go on production at this point, provided the reservoir pressure is effective to flow hydrocarbons up the production string 12 to the surface. Note that the packer 20 and the gravel pack assembly 22 may be left in the wellbore 4 and the well may be placed directly on production after retrieving the diverter tool 52, thereby saving the time to trip these articles out of the hole. In other wells, where reservoir pressure is insufficient, to complete the well, the rod pump may be lowered on a rod string to couple with the rod pump seat nipple 36 that was part of the completion string 10 during the run-in and the well may be placed on production. While detailed embodiments and implementations were described above, those of ordinary skill in the art will readily appreciate that the teachings of this disclosure are not limited only to these detailed embodiments and implementations but may be extended to other structures and alternative components.

Figure 3:
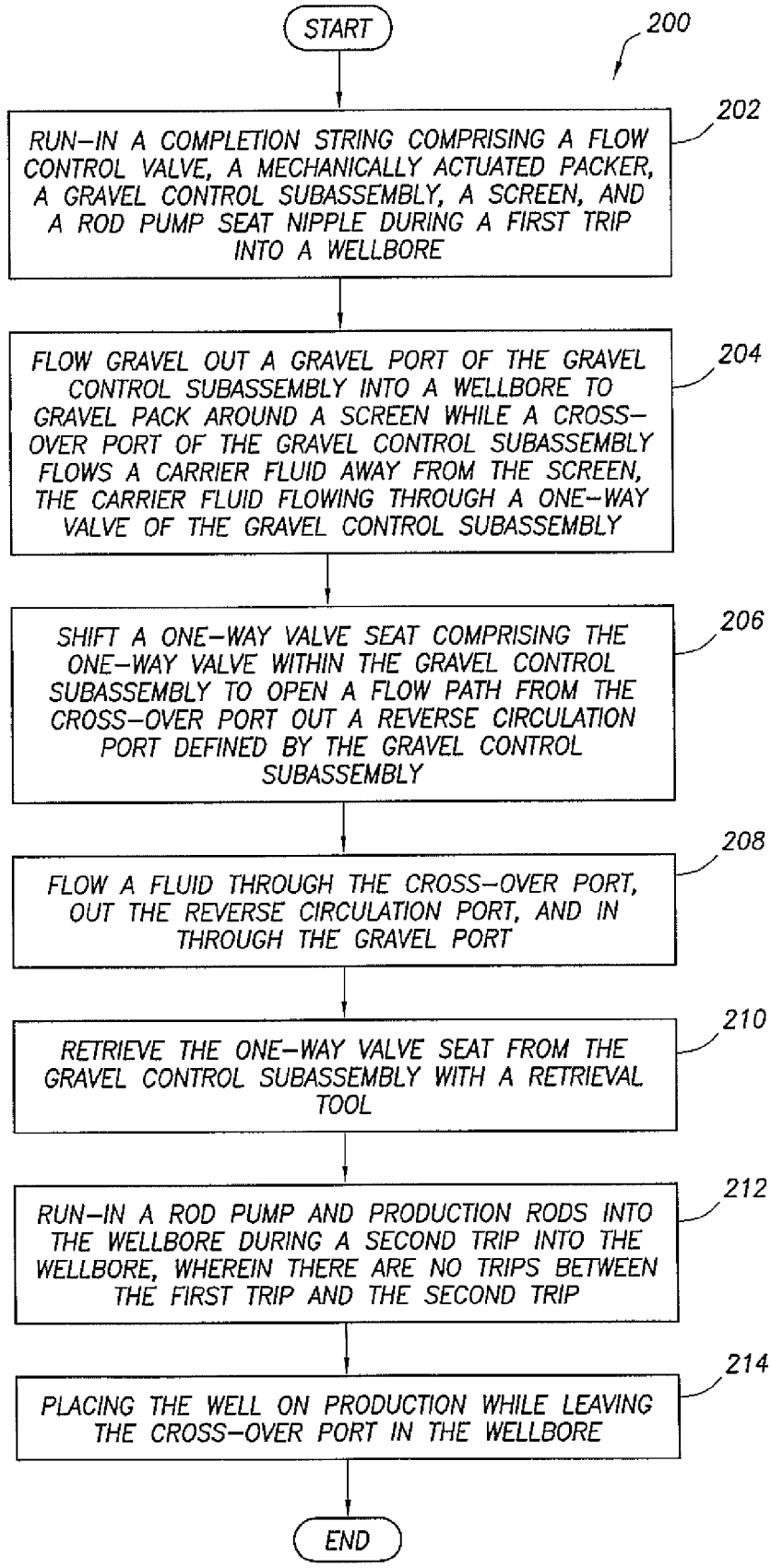
FIG. 3 is a flow chart of a method according to an embodiment of the disclosure.

Turning now to FIG. 3, a method 200 is described. At block 202, the completion string 10 is run into the wellbore 4. As described above with reference to FIG. 1A, FIG. 1B, FIG. 1C, and FIG. 1D, in an embodiment, the completion string 10 comprises the flow control valve 16, the mechanically actuated packer 20, the gravel pack assembly 22, the screen 24, and the rod pump seat nipple 36. In other embodiments, however, the completion string 10 may omit some of the components listed above. After running the completion string 10 into the wellbore 4, the packer 20 may be actuated and set in the casing of the wellbore 4. The activity of block 202 involves making a first trip into the hole, as the production tubing 12 may be comprised of a plurality of pipe joints that are made up one-by-one when running the completion string 10 into the wellbore 4.

At block 204, a gravel slurry comprising a carrier fluid and/or gel and gravel may be flowed down the production tubing 12, flowed out of the gravel port 28, the gravel may pack in the second annulus 8 proximate to and around the screen 24, the carrier fluid may pass through the screen 24 and flow through the cross-over port 32 of the gravel pack assembly 22. In flowing from the screen 24 to the cross-over port 32, the carrier fluid flows through a one-way valve. In an embodiment, the carrier fluid flows up the diverter mandrel 30 or a wash pipe. In an embodiment, the carrier fluid flows up the cross-over port 32 of the gravel pack assembly 22, flows up the micro-annulus 60 of the gravel pack assembly 22, flows up the first annulus 6 to the surface. As known to those of ordinary skill in the art, gravel may refer to proppants, sand, or other particulate matter of various granularity. In an embodiment, the carrier fluid, separated from the gravel by the screen 24, pushes the check ball 58 off a seal at the bottom of the ball check seat 56, wherein the check ball 58 is caged by the ball check seat 56, to flow up the cross-over port 32. In embodiment, a gravel squeeze operation like that described above may optionally be conducted before or after block 204.

At block 206, a one-way valve seat comprising the one-way valve shifts within the gravel pack assembly 22 to open a flow path from the cross-over port 32 out the reverse circulate port 34. For example, in an embodiment, the ball check seat 56 is shifted down within the gravel pack assembly 22, within the diverter tool 52, to open a flow path from the interior of the diverter tool 52 through the fifth port 74 in the diverter tool 52 and out through the reverse circulate port 34 to the exterior of the gravel pack assembly 22. In the run-in condition of the completion string 10, the ball check seat 56 blocks and seals the fifth port 74, preventing fluid flow from the interior of the diverter tool 52 through the fifth port 74 and out the reverse circulate port 34. The shifting of the ball check seat 56 may be motivated by pumping fluid, for example circulation fluid or carrier fluid, down the first annulus 6 to apply pressure down the micro-annulus 60, down the cross-over port 32, against the check ball 58 that engages the seal of the ball check seat 56 and blocks fluid flow downwards through the base of the ball check seat 56. In some embodiments, the ball check seat 56 may shift up rather than down. In some embodiments, alternatively, the ball check seat 56 does not block the fifth port 74 and the ball check seat 56 does not shift relative to the diverter tool 52, at least while the diverter tool 52 is coupled to the gravel pack assembly 22.

In block 208, a fluid is flowed through the cross-over port 32, out the reverse circulate port 34, and in through the gravel port 28. The process of block 208 may clear the completion string 10 of left-over or residual gravel slurry. In an embodiment, in the shifted position the ball check seat 56 allows for flowing fluid down the micro-annulus 60, down the cross-over port 32, through the ball check seat 56, out the fifth port 74, out the reverse circulate port 34, back in through the gravel port 28, up the interior of the diverter mandrel 30, and up the interior of the production tubing 12. Under some circumstances, the squeeze operation, the processing of block 204, and the processing of block 208 may be repeated one or more times, as needed. In an embodiment, the gravel pack may be pressure tested to determine if an effective gravel pack has been provided, for example by observing an about 1,000 PSI pressure differential across the gravel pack. The sleeve 76 may be shifted upwards to close the several ports of the gravel pack assembly 22 after completion of the activity of block 208. Alternatively, in another embodiment, the sleeve 76 may be shifted downwards to close the several ports of the gravel pack assembly 22.

At block 210, the one-way valve seat 56 is retrieved from the gravel pack assembly 22 with a retrieval tool. In an embodiment, the diverter tool 52 is retrieved from the gravel pack assembly 22 with a retrieval tool. Preferably the retrieval tool is run into the completion string 10 using a sand line, because a sand line is commonly available on drilling rigs and workover rigs and because using a sand line does not involve the time consuming sequence of making up numerous pipe joints on the trip into the hole and un-making numerous pipe joints on the trip out of the hole, such as would be involved in making a round trip with jointed pipe sections. Using slick line is another alternative to sand line that avoids the time of a round trip with jointed pipe sections. Retrieval of the diverter tool 52 on sand line, on slick line, on wire line, or on coiled tubing is not considered to constitute a trip.

At block 212, a rod pump and production rods are run into the wellbore 4, down the completion string 10. The rod pump mates with the rod pump seat nipple 36 which was run in with the completion string 10 during the first trip into the hole. The process of running in the rod pump and production rods may be viewed as a second trip into the hole, as each additional rod section is coupled to the preceding rod section when running into the hole. Observe that no trips comprising 10 or more connections/disconnections have intervened between the first trip into the hole described with reference to block 202 above and the second trip described here with reference to block 212, because the process of making and unmaking numerous connections or other couplings is not involved. The flow control valve 16 may be closed either before or after the activity of block 210 and/or block 212. Alternatively, in some situations the flow control valve 16 may be left open, for example to promote off-venting of excess natural gas released by the formation. In a well with sufficient reservoir pressure, there may be no need of mechanical lift to flow hydrocarbons to the surface—the hydrocarbons may flow freely—and the activity of block 212 may be omitted in such cases.

At block 214, the well is placed on production while leaving the cross-over port 32 in the wellbore 4. In an embodiment, the micro-annulus 60 of the gravel pack assembly 22 is also left in the wellbore 4. Additionally, the flow control valve 16 and the mechanically actuated packer 20 are left in the wellbore 4. The method 200 can be observed to provide a single trip completion, thereby reducing the customary number of trips consumed to bring some wells in some fields into production. Reducing the number of trips needed to go on production saves money.

Figure 4:
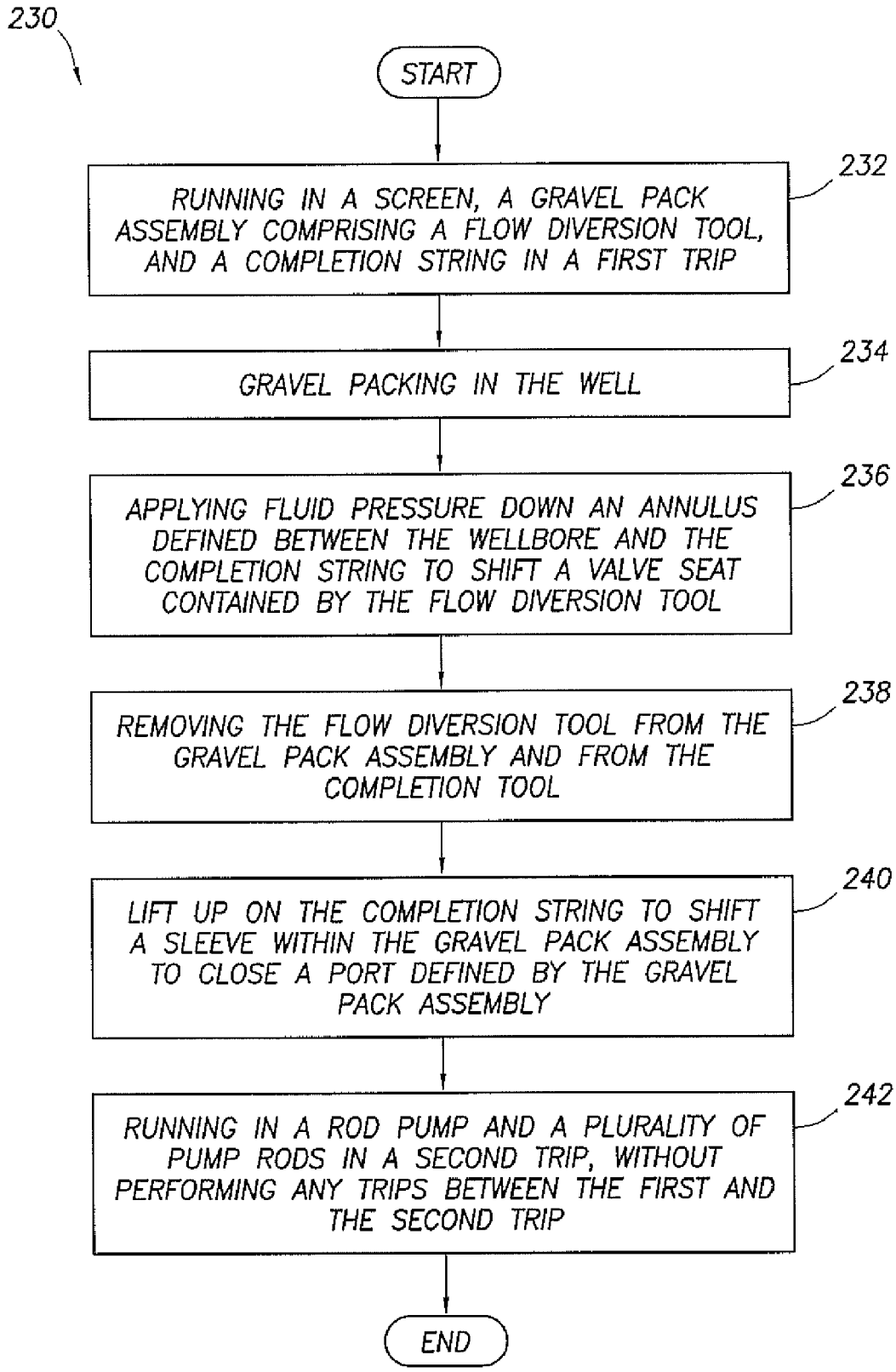
FIG. 4 is a flow chart of another method according to an embodiment of the disclosure.

Turning now to FIG. 4, a method 230 for completing a wellbore is described. At block 232, a screen, a gravel pack assembly comprising a flow diversion tool, and a completion string is run into the wellbore 4 in a first trip. A trip into or out of the hole may be distinguished from running articles into the hole or retrieving articles out of the hole with a substantially continuous line, for example a sand line, a wire line, a slick line, and a coiled tubing. Running in an article on the continuous line can be completed with substantially continuous deployment of the line into the hole. Likewise, retrieving an article on the continuous line can be completed with substantially continuous withdrawal of the line from the hole. Unlike running in or out of the hole with a continuous line, tripping into the hole entails lowering a work string a limited distance, stopping the work string, connecting an additional joint into the work string, lowering the work string again a limited distance, stopping the work string, etc. Tripping out of the hole, similarly, entails lifting the work string a limited distance, stopping the work string, disconnecting a joint of pipe, stowing the joint, lifting the work string again a limited distance, stopping the work string, disconnecting another joint of pipe, stowing the other joint, etc. These differences between tripping into and out of the hole versus running into the hole or running out of the hole using a continuous line are well known to those of ordinary skill in the art.

At block 234, the well associated with the wellbore 4 is gravel packed. For example, a gravel slurry is flowed down the completion string, out the gravel pack assembly, to place a gravel pack in the annular space outside the screen 24. The gravel may pack the second annulus 8 and around the screen 24, and possibly to some extent into a formation proximate to the screen. In an embodiment, the gravel packing may comprise first flowing and packing gravel slurry into the formation proximate to the screen, for example a perforated and/or a fractured formation. The gravel packing may be conducted to achieve an effective barrier to propagation of fines into the inside of the completion string 10 and/or the production string 12, for example as determined by measuring a pressure differential across the gravel pack.

At block 236, fluid pressure may be applied down an annulus defined between the wellbore and the completion string to shift a valve seat contained by the flow diversion tool. Shifting the valve seat may open an additional fluid flow path through the gravel pack assembly, thereby promoting a different operating mode of the gravel pack assembly. Alternatively, in another embodiment, the valve seat may not need to be shifted and the additional fluid flow path may be defined in the run-in state of the gravel pack assembly.

At block 238, the flow diversion tool is removed from the gravel pack assembly. For example, a retrieval tool is run into the wellbore 4 on a substantially continuous line such as one of a sand line, a wire line, a slick line, and a coiled tubing. The retrieval tool may attach to the flow diversion tool. The continuous line is then withdrawn from the wellbore 4, retrieving the flow diversion tool from the gravel pack assembly and from the completion string. At block 240, in an embodiment, the completion string may be lifted up or lowered down at some time prior to placing the well on production to shift a sleeve to close a port defined by the gravel pack assembly. At block 242, a rod pump and a plurality of pump rods are run in during a second trip, without performing any trips between the first trip and the second trip. After running in the rod pump and pump rods, the well may be placed on production. Alternatively, as discussed further above, in a freely flowing well the processing of block 242 may be omitted. In an embodiment, the gravel pack assembly may comprise a cross-over port that remains in the wellbore after removing the flow diversion tool from the gravel pack assembly and when the well is placed on production. In an embodiment, the completion string may comprise a mechanical packer.

The screen described with reference to method 230 may be substantially similar to the screen 24 described above with reference to FIG. 1D. The gravel pack assembly described with reference to method 230 may be substantially similar to the gravel pack assembly described above with reference to FIG. 1C. The flow diversion tool described with reference to method 230 may be substantially similar to the diverter tool 52 described above with reference to FIG. 2A. The cross-over port described with reference to method 230 may be substantially similar to the cross-over port 32 described above with reference to FIG. 1C. The port defined by the gravel pack assembly described with reference to method 230 may be substantially similar to the gravel port 28 described above with reference to FIG. 1C. The mechanical packer described with reference to method 230 may be substantially similar to the mechanical packer described above with reference to FIG. 1B.

In an embodiment, a downhole production assembly may comprise a flow control valve; a mechanically actuated packer coupled to the flow control valve in a run-in state of the production assembly; a gravel pack assembly coupled to the mechanically actuated packer, comprising an outer assembly defining a cross-over port, defining a gravel port, and defining a reverse circulation port, an inner assembly carried within the outer assembly that is coupled to the flow control valve and defining a first port aligned with the gravel port in the run-in state of the production assembly and defining a second port aligned with an opening of the cross-over port in the run-in state of the production assembly, and a diverter tool carried with the inner assembly in the run-in state of the production assembly and removed from the inner assembly in a production state of the production assembly; and a screen coupled to the gravel pack assembly. In an embodiment, the production assembly may further comprise a rod pump seat nipple in the run-in state of the production assembly. In an embodiment, the gravel pack assembly may further comprise a one-way valve coupled to the reverse circulate port in a run-in state of the production assembly. In an embodiment, the one-way valve may comprise an elastomeric boot. In an embodiment, the diverter tool may be retrievable with a retrieval tool deployed into the production assembly coupled to one of a sand line, a slick line, a wire line, a coiled tubing, and a pipe string. In an embodiment, the gravel pack assembly may further comprise a sleeve that closes the reverse circulation port, the cross-over port, and the gravel port in the production state of the production assembly. In an embodiment, the sleeve is shifted to close by moving the inner assembly to engage an interior lip of the sleeve with an exterior shoulder of the inner assembly.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of completing a wellbore, comprising:

running in a screen, a gravel pack assembly comprising a flow diversion tool, and a completion string in a first trip;

gravel packing the well; and removing the flow diversion tool from the gravel pack assembly and from the completion string, wherein the gravel pack assembly comprises a cross-over port and wherein the cross-over port remains in the wellbore after removing the flow diversion tool from the gravel pack assembly.

2. The method of claim 1, wherein removing the flow diversion tool comprises removing the flow diversion tool with one of a sand line, a wire line, a coiled tubing, a slick line, and a pipe string.

3. The method of claim 1, further comprising running in a rod pump and a plurality of pump rods in a second trip, without performing any trips between the first trip and the second trip.

4. The method of claim 1, further comprising applying fluid pressure down an annulus defined between the wellbore and the completion string to shift a valve seat contained by the flow diversion tool.

5. The method of claim 4, wherein the flow diversion tool comprises a stop to locate the valve seat when the valve seat shifts.

6. The method of claim 1, further comprising lifting up on the completion string to shift a sleeve within the gravel pack assembly to close a port defined by the gravel pack assembly.

7. The method of claim 1, wherein the completion string comprises a mechanical packer.

8. A well completion tool, comprising:

a gravel pack assembly; and a diverter tool releasably coupled to the gravel pack assembly in a run-in state of the completion tool and removable from the gravel pack assembly in a production state of the completion tool, wherein the gravel pack assembly comprises a cross-over port and wherein the cross-over port is configured to remain in a wellbore when the diverter tool is removed from the gravel pack assembly.

9. The well completion tool of claim 8, wherein the diverter tool comprises a first valve coupled to the diverter tool.

10. The well completion tool of claim 9, wherein the first valve is retained by a shear retainer in a run-in state of the completion tool and wherein the diverter tool further comprises a stop to locate the first valve in a reverse circulation state of the completion tool.

11. The well completion tool of claim 8, wherein the gravel pack assembly further defines a reverse circulate port and further comprises a second valve that blocks fluid flow from outside the completion tool through the reverse circulate port.

12. The well completion tool of claim 11, wherein the second valve comprises an elastomeric boot coupled to the outside of the gravel pack assembly.

13. The well completion tool of claim 8, wherein the diverter tool changes fluid flow paths through the gravel pack assembly in response to fluid pressure differentials urged upon the gravel pack assembly.

14. A method of wellbore completion, comprising:

flowing a gravel slurry out of a gravel pack assembly, the gravel pack assembly comprising a cross-over port;

blocking, by a valve coupled to the gravel pack assembly, a reverse fluid flow through the cross-over port to enable a pressure differential to be established that drives a valve seat coupled to the valve to shear retainers and to displace to a shifted position located by stops coupled to the gravel pack assembly; and placing a well associated with the wellbore on production while leaving the cross-over port of the gravel pack assembly in the wellbore.

15. The method of claim 14, wherein the flowing the gravel slurry is performed while flowing a fluid through the cross-over port and up to the surface in an annulus between the wellbore and a production string coupled to the gravel pack assembly.

16. The method of claim 14, further comprising running a completion string that includes the gravel pack assembly and a rod pump seat nipple into the wellbore before flowing the gravel slurry.

17. The method of claim 14, wherein in an unshifted position the valve seat blocks a flow path from the cross-over port out the gravel pack assembly through a reverse circulate port.

18. The method of claim 17, blocking flow from an exterior of the reverse circulate port to an interior of the gravel pack assembly, at least in part, by a reversing boot.

19. The method of claim 14, further comprising retrieving the valve seat and valve from the gravel pack assembly and placing a well associated with the wellbore on production.

20. The method of claim 14, wherein placing the well on production comprises running in a rod pump and a plurality of pump rods.

* * * * *